US010070485B1

(12) United States Patent
Thrun et al.

(10) Patent No.: US 10,070,485 B1
(45) Date of Patent: Sep. 4, 2018

(54) AUTOMATIC HEATING SYSTEM AND METHOD

(71) Applicant: Silicon Valley Factory LLC, Los Altos Hills, CA (US)

(72) Inventors: Sebastian Thrun, Los Altos, CA (US); David St. Martin, San Rafael, CA (US); Arash Kani, Roxbury, MA (US)

(73) Assignee: Silicon Valley Factory LLC, Los Altos Hills, CA (US)

( * ) Notice: Subject to any disclaimer, the term of this patent is extended or adjusted under 35 U.S.C. 154(b) by 0 days.

(21) Appl. No.: 15/489,465

(22) Filed: Apr. 17, 2017

(51) Int. Cl.

| | |
|---|---|
| ***H05B 6/12*** | (2006.01) |
| ***H05B 6/06*** | (2006.01) |
| ***H05B 6/02*** | (2006.01) |
| ***H05B 6/10*** | (2006.01) |

(52) U.S. Cl.
CPC ..... *H05B 6/062* (2013.01); *H05B 6/105* (2013.01); *H05B 6/1209* (2013.01)

(58) Field of Classification Search
CPC ..... A47J 27/62; A47J 45/068; A47J 45/071; A47J 36/00; A47J 45/07; H05B 1/0269; H05B 1/0266; H05B 6/12; H05B 2213/06
USPC ..... 219/620–622, 412–414, 506, 702, 708, 219/713, 714, 624, 627, 667; 99/325–333, 342, 334, 451; 426/19, 273
See application file for complete search history.

(56) References Cited

U.S. PATENT DOCUMENTS

| | | | | |
|---|---|---|---|---|
| 3,530,499 | A * | 9/1970 | Schroeder | H05B 3/685 219/621 |
| 4,323,773 | A | 4/1982 | Carpenter | |
| 4,381,438 | A * | 4/1983 | Goessler | A47J 27/62 219/431 |
| 4,749,836 | A | 6/1988 | Matsuo et al. | |
| 4,913,038 | A | 4/1990 | Burkett | |
| 5,045,333 | A | 9/1991 | Petrofsky | |
| 5,877,477 | A | 3/1999 | Petty | |
| 6,660,983 | B2 | 12/2003 | Monforton | |
| 6,740,855 | B1 | 5/2004 | Decobert | |

(Continued)

FOREIGN PATENT DOCUMENTS

| | | |
|---|---|---|
| EP | 1422163 | 5/2004 |
| JP | 2006153432 | 6/2006 |

OTHER PUBLICATIONS

Author Unknown, "Induction Heating", from Wikipedia, the free encyclopedia. Last modified Jan. 10, 2017.

(Continued)

*Primary Examiner* — Quang Van
(74) *Attorney, Agent, or Firm* — Van Pelt, Yi & James LLP

(57) ABSTRACT

In various embodiments, an apparatus includes a top portion, a bottom portion adapted to receive the top portion to define a space enclosed within the top portion and bottom portion, where the bottom portion includes a conductive structure, the conductive structure configured to receive electromagnetic energy from an EM source. The apparatus may also include an electronic tag configured to encode information about contents of the space. In various embodiments, a heating apparatus includes an electromagnetic (EM) source and a controller configured to: receive data associated with a heatable load, determine heating instructions based at least in part on the received data, and control the EM source based on the determined heating instructions.

14 Claims, 7 Drawing Sheets

100

(56) References Cited

U.S. PATENT DOCUMENTS

| | | | | |
|---|---|---|---|---|
| 8,191,465 | B2 | 6/2012 | Sager | |
| 8,207,479 | B2 | 6/2012 | Ben-Shmuel | |
| 8,835,816 | B2 | 9/2014 | McIntyre | |
| 9,414,442 | B2 | 8/2016 | Torres | |
| 9,528,972 | B2 | 12/2016 | Minvielle | |
| 9,606,522 | B2 | 3/2017 | Hoffman | |
| 9,644,847 | B2 | 5/2017 | Bhogal | |
| 2004/0018278 | A1 | 1/2004 | Popplewell | |
| 2007/0092670 | A1 | 4/2007 | Quella | |
| 2007/0137633 | A1 | 6/2007 | McFadden | |
| 2007/0278221 | A1 | 12/2007 | Skaife | |
| 2008/0083338 | A1 | 4/2008 | Niemetz | |
| 2008/0105134 | A1 | 5/2008 | Elston, III | |
| 2008/0108388 | A1 | 5/2008 | Ebrom | |
| 2009/0188396 | A1 | 7/2009 | Hofmann | |
| 2009/0194526 | A1 * | 8/2009 | Buchanan | H05B 6/062 219/600 |
| 2009/0208615 | A1 | 8/2009 | Domingues | |
| 2009/0236334 | A1 | 9/2009 | Ben-Shmuel | |
| 2010/0213187 | A1 | 8/2010 | Bandholz | |
| 2010/0320189 | A1 | 12/2010 | Buchheit | |
| 2011/0303652 | A1 | 12/2011 | Sano | |
| 2012/0063753 | A1 | 3/2012 | Cochran | |
| 2013/0092032 | A1 | 4/2013 | Cafferty | |
| 2013/0269539 | A1 | 10/2013 | Polt | |
| 2013/0306627 | A1 | 11/2013 | Libman | |
| 2014/0263640 | A1 | 9/2014 | Heit | |
| 2014/0377417 | A1 | 12/2014 | Martinez | |
| 2015/0057773 | A1 | 2/2015 | Minvielle | |
| 2016/0198885 | A1 | 7/2016 | Logan | |
| 2016/0220064 | A1 | 8/2016 | Young | |
| 2016/0295640 | A1 | 10/2016 | De Samber | |
| 2016/0327279 | A1 | 11/2016 | Bhogal | |
| 2016/0355287 | A1 | 12/2016 | Keller | |
| 2017/0016623 | A1 | 1/2017 | Rabie | |
| 2017/0135383 | A1 | 5/2017 | Liss | |

OTHER PUBLICATIONS

Butz et al., "Recent Developments in Noninvasive Techniques for Fresh Fruit and Vegetable Internal Quality Analysis", from R: Concise Reviews in Food Science, published Nov. 21, 2005.

RF Solid-State Technology with Goji. http://www.gojifoodsolutions.com/rf-cooking-technology. Jan. 29, 2017.

Translation of JP2006153432A, Nozawa et al, Heating Cooker Information medium and program, Jun. 15, 2006, ProQuest, Mar. 25, 2018.

* cited by examiner

100

400

600

650

800

700

1150

1100

1200

1250

AUTOMATIC HEATING SYSTEM AND METHOD

BACKGROUND OF THE INVENTION

There are many challenges in food preparation. Cooking can be time-consuming and messy. For example, ingredient selection, acquisition, transportation, and preparation can be inconvenient. In spite of the effort expended, sometimes the results of meal preparation are unsatisfying. Successfully extracting flavors from ingredients typically requires lengthy cooking processes such as stewing or skilled processes such as browning. The final tastiness of food depends on the characteristics of the ingredients and a person's tastes and preferences.

Various types of cooking devices are available. For example, slow-cookers and pressure-cookers may simplify food preparation by facilitating unattended cooking. However, conventional slow-cookers are typically slow and limited to specific cooking techniques, e.g., simmering at low heat. Conventional pressure-cookers typically reduce cooking time. However, conventional pressure-cooking requires liquid and is not suitable for some techniques such as roasting or frying. Also, the time needed to pressurize and de-pressurize the cooking chamber can be time-consuming. Both slow cookers and pressure-cookers also typically require a cook to prepare (e.g., slice and portion) the ingredients.

Pre-packaged chilled convenience meals have been popular since the 1950*s* for its ease of preparation. Typical convenience meals are packaged in a tray and frozen. The consumer heats the meal in an oven or microwave and consumes the food directly from the tray. However, conventional pre-packaged convenience meals might be unhealthy and not tasty, and results may vary depending on the microwave or oven used to heat the meal. For example, the food might be heated unevenly.

BRIEF DESCRIPTION OF THE DRAWINGS

Various embodiments of the invention are disclosed in the following detailed description and the accompanying drawings.

DETAILED DESCRIPTION

Figure 1:
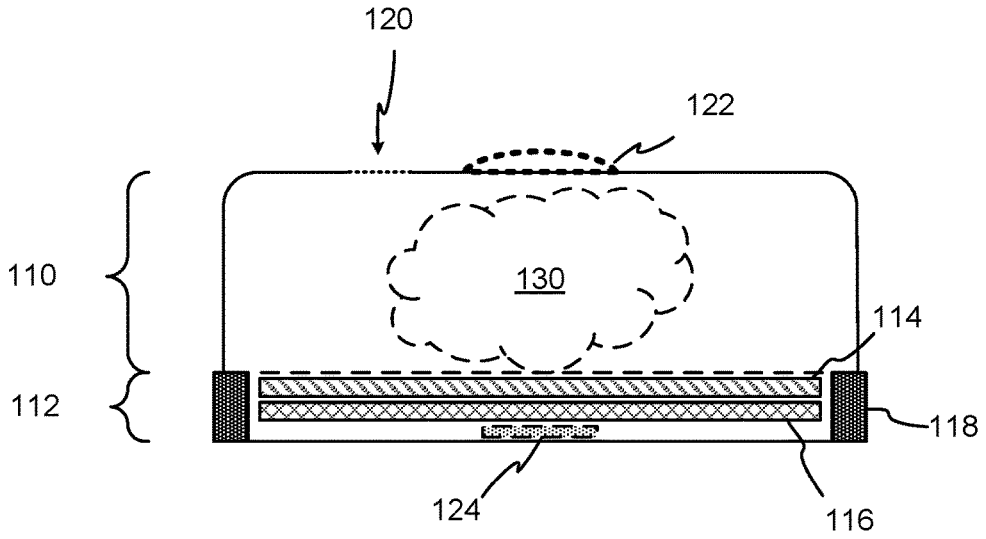
FIG. 1 is a block diagram illustrating an embodiment of an apparatus to store and transport matter.

The invention can be implemented in numerous ways, including as a process; an apparatus; a system; a composition of matter; a computer program product embodied on a computer readable storage medium; and/or a processor, such as a processor configured to execute instructions stored on and/or provided by a memory coupled to the processor. In this specification, these implementations, or any other form that the invention may take, may be referred to as techniques. In general, the order of the steps of disclosed processes may be altered within the scope of the invention. Unless stated otherwise, a component such as a processor or a memory described as being configured to perform a task may be implemented as a general component that is temporarily configured to perform the task at a given time or a specific component that is manufactured to perform the task. As used herein, the term 'processor' refers to one or more devices, circuits, and/or processing cores configured to process data, such as computer program instructions.

A detailed description of one or more embodiments of the invention is provided below along with accompanying figures that illustrate the principles of the invention. The invention is described in connection with such embodiments, but the invention is not limited to any embodiment. The scope of the invention is limited only by the claims and the invention encompasses numerous alternatives, modifications and equivalents. Numerous specific details are set forth in the following description in order to provide a thorough understanding of the invention. These details are provided for the purpose of example and the invention may be practiced according to the claims without some or all of these specific details. For the purpose of clarity, technical material that is known in the technical fields related to the invention has not been described in detail so that the invention is not unnecessarily obscured.

An automatic heating system is disclosed. In various embodiments, an automatic heating system includes an apparatus (also referred to as a chamber) and a heating apparatus. In various embodiments, the chamber is adapted to store and transport a heatable load (e.g., food) and the chamber can be directly inserted into the heating apparatus. The heatable load may be heated by the heating apparatus according to instructions (e.g., programmed heating cycles) adapted for the properties of the heatable load and/or a user's preferences. The heatable load is directly consumable from the packaging. For simplicity, the examples provided here often describe food preparation, but the techniques also find application in the preparation of other heatable loads.

In various embodiments, an apparatus (also referred to as a chamber) includes a top portion, a bottom portion adapted to receive the top portion to define a space enclosed within the top portion and bottom portion, and an electronic tag configured to encode information about contents of the space. The bottom portion includes a conductive structure configured to receive electromagnetic energy from an electromagnetic (EM) source. In various embodiments, a heating apparatus includes an EM source and a controller. The controller is configured to receive data associated with a heatable load, determine heating instructions based at least in part on the received data and control the EM source based on the determined heating instructions. In some embodiments, the controller comprises one or more processors, as further described herein with respect to FIG. 2. In various embodiments, a method of operating an automatic heating system includes receiving data associated with a heatable load, where the data is encoded in a tag. The method includes determining heating instructions based at least in part on the received data. For example, the data encoded in the tag may be mapped to at least one heating cycle based at least in part on at least one association stored in a database. A resonant circuit and an EM source are instructed to execute the determined heating instructions.

FIG. 1 is a block diagram illustrating an embodiment of an apparatus 100 to store and transport matter 130. For example, in various embodiments the apparatus 100 is adapted to store and transport matter 130 comprising food or other heatable loads. The apparatus 100 includes a top portion 110, a bottom portion 112, a metal layer 114, a membrane 116, a seal 118, and a pressure relief valve 120.

The bottom portion 112 is adapted to receive matter 130. The bottom portion holds food or other types of loads. For example, the bottom portion may be a plate or bowl. As further described herein, a user may directly consume the matter 130 from the bottom portion 112.

The top portion 110 is adapted to fit the bottom portion 112 to form a chamber. For example, the top portion may be a cover for the bottom portion. In some embodiments, the top portion is deeper than the bottom portion and is a dome, cloche, or other shape. Although not shown, in some embodiments, the top portion is shallower than the bottom portion. In some embodiments, the top portion is transparent and the matter 130 can be observed during a preparation/heating process. In some embodiments, the chamber is at least partially opaque. For example, portions of the chamber may be opaque to prevent users from inadvertently touching the apparatus when the chamber is hot.

The top portion 110 and the bottom portion 112 may be made of a variety of materials. Materials may include glass, plastic, metal, compostable/fiber-based materials, or a combination of materials. The top portion 110 and the bottom portion 112 may be made of the same material or different materials. For example, the top portion 110 is metal while the bottom portion 112 is another material.

The seal 118 is adapted to join the top portion 110 to the bottom portion 112. In one aspect, the seal may provide an air-tight connection between the top portion and the bottom portion, defining a space enclosed within the top portion and the bottom portion. In some embodiments, in the space, matter 130 is isolated from an outside environment. The pressure inside the space may be different from atmospheric pressure. The seal may also prevent leakage and facilitate pressure buildup within the chamber in conjunction with pressure relief valve 120 and/or clamp 614.1, 614.2 of the heating apparatus of FIGS. 6A and 6B as further described herein.

In one aspect, a chamber formed by the top portion 110 and the bottom portion 112 may store and/or preserve food. For example, food may be vacuum-sealed inside the chamber. In another aspect, the chamber contains the food during a heating process. In various embodiments, the chamber can be directly be placed on a heating apparatus. For example, a user may obtain the chamber from a distributor (e.g., a grocery store), heat up the contents of the chamber without opening the chamber, and consume the contents of the chamber directly. In various embodiments, the same chamber stores/preserves food, is a transport vessel for the food, can be used to cook the food, and the food can be directly consumed from the chamber after preparation.

The metal layer 114 (also referred to as a conductive structure) heats in response to an EM source. In some embodiments, the metal layer heats by electromagnetic induction. The metal layer can heat matter 130. For example, heat in the metal layer may be conducted to the contents. As further described herein, the heating of the matter (in some cases in combination with a controlled level of moisture) in the chamber allows for a variety of preparation methods including dry heat methods such as baking/roasting, broiling, grilling, sauteing/frying; moist heat methods such as steaming, poaching/simmering, boiling; and combination methods such as braising and stewing. In various embodiments, several different heating methods are used in a single preparation process, e.g., the preparation process comprising a sequence of heating cycles.

The metal layer may be made of a variety of materials. In some embodiments, the metal layer includes an electrically conducting material such as a ferromagnetic metal, e.g., stainless steel. In various embodiments, the metal is processed and/or treated in various ways. For example, in some embodiments, the metal is ceramic-coated. In some embodiments, the metal layer is made of any metallic material, e.g., aluminum.

The membrane 116 (also referred to as a membrane region) is adapted to control an amount of liquid. For example, the membrane may provide controlled flow of moisture through the membrane. In various embodiments, the membrane may release liquids (e.g., water) inside a space defined by the top portion 110 and the bottom portion 112. For example, water can be released in a controlled manner and transformed to steam during a heating process. In various embodiments, the membrane may absorb liquids. For example, the membrane may absorb juices released by food during a heating process.

In some embodiments, the membrane 116 is adapted to provide insulation between the metal layer 114 and a surface of the bottom portion 112. For example, if the bottom portion is a glass plate, the membrane may prevent the glass plate from breaking due to heat.

The membrane 116 may be made of a variety of materials. In some embodiments, the membrane includes a heat-resistant spongy material such as open-cell silicone. In some embodiments, the membrane includes natural fiber and/or cellulose. The material may be selected based on desired performance, e.g., if the membrane is intended to absorb liquid or release liquid, a rate at which liquid should be absorbed/released, a quantity of liquid initially injected in the membrane, etc.

The pressure relief valve 120 regulates pressure in a space defined by the top portion 110 and the bottom portion 112. In various embodiments, the pressure relief valve relieves pressure buildup within the chamber. For example, in various embodiments the valve activates/deploys automatically in response to sensed temperature or pressure inside the chamber meeting a threshold. In some embodiments, the valve is activated by a heating apparatus such as heating apparatus 200 of FIG. 2. For example, the valve may be activated at a particular stage or time during a cooking process. The pressure relief valve allows the contents of the chamber to be heated at one or more pre-determined pressures including at atmospheric pressure. In various embodiments, this accommodates pressure heating techniques.

In some embodiments, the apparatus includes a handle 122. The handle may facilitate handling and transport of the apparatus. For example, the handle may enable a user to remove the apparatus from a base (e.g., from the heating apparatus 200 of FIG. 2). In various embodiments, the handle is insulated to allow safe handling of the apparatus when the rest of the apparatus is hot. In some embodiments, the handle is collapsible such that the apparatus is easily stored. For example, several apparatus may be stacked. FIG. 1 shows one example of the handle placement. The handle may be provided in other positions or locations as further described herein with respect to FIGS. 7 and 8.

In some embodiments, the apparatus includes an electronic tag 124. The electronic tag encodes information about the apparatus. By way of non-limiting example, the encoded information includes identification of matter 130, characteristics of the contents, and handling instructions. Using the example of a food package, the electronic tag may store information about the type of food inside the package (e.g., steak, fish, vegetables), characteristics of the food (e.g., age/freshness, texture, any abnormalities), and cooking instructions (e.g., sear the steak at high heat followed by baking at a lower temperature). Although shown below membrane 116, the electronic tag may be provided in other locations such as below handle 122, on a wall of the top portion 110, among other places.

Figure 10:
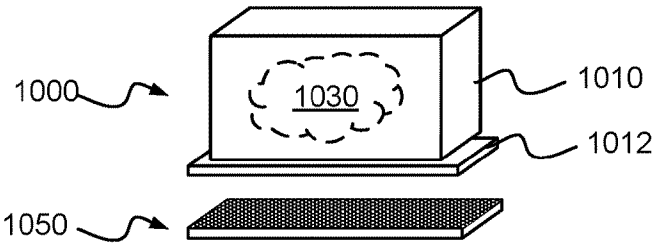
FIG. 10 is a block diagram illustrating an embodiment of a system for heating in a perspective view.
Figure 9:
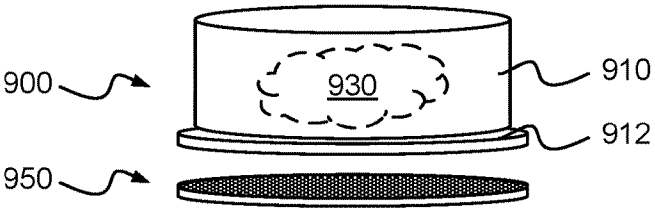
FIG. 9 is a block diagram illustrating an embodiment of a system for heating in a perspective view.

The apparatus 100 may be a variety of shapes and sizes as further described herein with respect to FIGS. 9 and 10. In some embodiments, the shape of the apparatus is compatible with a heating apparatus such as heating apparatus 200 of FIG. 2. For example, the apparatus may be of a suitable surface area and shape to be heated by apparatus 200. For example, apparatus 100 may be around 7 inches in diameter and around 2 inches in height.

Figure 2:
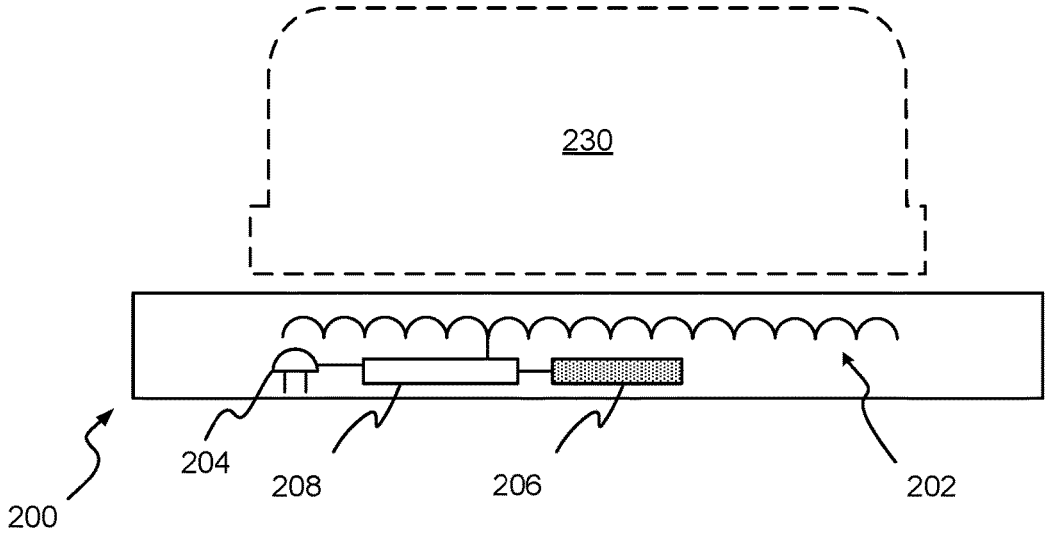
FIG. 2 is a block diagram illustrating an embodiment of an apparatus for heating.

FIG. 2 is a block diagram illustrating an embodiment of an apparatus 200 for heating. For example, in various embodiments the heating apparatus 200 is adapted to receive an apparatus 230 (also referred to as a chamber) and heat contents of the chamber 230. An example of the chamber 230 is apparatus 100 of FIG. 1. The heating apparatus 200 includes an EM source 202, one or more sensors 204, electronic tag reader 206, and controller 208.

The EM source 202 heats electrically conductive materials. In various embodiments, the EM source is an RF source that provides inductive heating of metals such as ferromagnetic or ferrimagnetic metals. For example, the EM source 202 may include an electromagnet and an electronic oscillator. In some embodiments, the oscillator is controlled by controller 208 to pass an alternating current (AC) through an electromagnet. The alternating magnetic field generates eddy currents in a target such as metal layer 114 of FIG. 1, causing the metal layer to heat. Heating levels and patterns may be controlled by the frequency of the AC and when to apply the AC to the electromagnet as further described herein.

The sensor(s) 204 are adapted to detect characteristics of contents of chamber 230 including any changes that may occur during a heating process. A variety of sensors may be provided including a microphone, camera, thermometer, and/or hygrometer, etc. A microphone may be configured to detect sounds of the matter being heated. A camera may be configured to detect changes in the appearance of the matter being heated, e.g., by capturing images of the matter. A hygrometer may be configured to detect steam/vapor content of the chamber. For example, the hygrometer may be provided near an opening or pressure relief valve such as valve 120 of FIG. 1 to detect moisture escaping the chamber. The information captured by the sensors may be processed by controller 208 to determine a stage in the cooking process or a characteristic of the matter being heated as further described herein. In this example, the sensor(s) are shown outside the chamber 230. In some embodiments, at least some of the sensor(s) are provided inside the chamber 230.

The electronic tag reader 206 reads information about contents of the chamber 230 such as characteristics of packaged food. The information encoded in the tag may include properties of the contents, instructions for preparing/heating the contents, etc. In various embodiments, the electronic tag reader is configured to read a variety of tag types including barcodes, QR codes, RFIDs and any other tags encoding information.

The controller 208 controls operation of the heating apparatus 200. An example of the controller is controller 308 of FIG. 3. In various embodiments, the controller executes instructions for processing contents of chamber 230. In some embodiments, the instructions are obtained from reading an electronic tag of the chamber 230 via the electronic tag reader 206. In some embodiments, the controller requests instructions from a remote server based on the contents. The controller controls the EM source 202 to implement heating levels and patterns, e.g., activating the electromagnet to carry out the heating instructions.

In some embodiments, the apparatus includes one or more network interfaces (not shown). A network interface allows controller 208 to be coupled to another computer, computer network, or telecommunications network using a network connection as shown. For example, through the network interface, the controller 208 can receive information (e.g., data objects or program instructions) from another network or output information to another network in the course of performing method/process steps. Information, often represented as a sequence of instructions to be executed on a processor, can be received from and outputted to another network. An interface card or similar device and appropriate software implemented by (e.g., executed/performed on) controller 208 can be used to connect the heating apparatus 200 to an external network and transfer data according to standard protocols. For example, various process embodiments disclosed herein can be executed on controller 208, or can be performed across a network such as the Internet, intranet networks, or local area networks, in conjunction with a remote processor that shares a portion of the processing. Additional mass storage devices (not shown) can also be connected to controller 208 through the network interface.

In some embodiments, the apparatus includes one or more I/O devices (not shown). An I/O device interface can be used in conjunction with heating apparatus 200. The I/O device interface can include general and customized interfaces that allow the controller 208 to send and receive data from other devices such as sensors, microphones, touch-sensitive displays, transducer card readers, tape readers, voice or handwriting recognizers, biometrics readers, cameras, portable mass storage devices, and other computers.

In various embodiments, controller 208 is coupled bidirectionally with memory (not shown), which can include a first primary storage, typically a random access memory (RAM), and a second primary storage area, typically a read-only memory (ROM). As is well known in the art, primary storage can be used as a general storage area and as scratch-pad memory, and can also be used to store input data and processed data. Primary storage can also store programming instructions and data, in the form of data objects and text objects, in addition to other data and instructions for processes operating on controller 208. Also as is well known in the art, primary storage typically includes basic operating instructions, program code, data and objects used by the controller 208 to perform its functions (e.g., programmed instructions). For example, memory can include any suitable computer-readable storage media, described below, depending on whether, for example, data access needs to be bi-directional or uni-directional. For example, controller 208 can also directly and very rapidly retrieve and store frequently needed data in a cache memory (not shown).

In some embodiments, the controller implements the heating instructions based on sensor readings. The controller may determine that a heating stage is complete, e.g., the food has reached a desired state, based on sensor readings. For example, when a level of moisture inside the chamber 230 drops below a threshold, a Maillard reaction begins and the food becomes browned. The Maillard reaction may be indicated by a characteristic sound (e.g., sizzling). For example, in various embodiments, the controller determines a characteristic of the food being prepared using signals collected by the sensor(s) 204. The controller receives a sensor reading from the microphone and/or other sensors and determines that the Maillard reaction has begun based on the sensor reading meeting a threshold or matching a profile. For example, the color of food may indicate whether the food has been cooked to satisfaction. The controller receives a sensor reading from the camera and/or other sensors and determines that food has been cooked to a desired level of tenderness based on the sensor reading meeting a threshold or matching a profile.

The controller may adjust a heating stage or a heating power level based on sensor readings. For example, in various embodiments at the end of a default heating time indicated by heating instructions, the controller checks sensor readings. The sensor readings indicate that the food is not sufficiently browned. The controller may then extend the heating time such that the food is more browned.

In various embodiments, the heating apparatus includes a cradle or support for apparatus 100. For example, the support may be separated from the heating apparatus, the apparatus 100 inserted into the support, and the support returned to the heating apparatus. The support may support a circumference/walls of apparatus 100.

In various embodiments, the heating apparatus includes a switch (not shown). The switch may power on the heating apparatus and/or receive user input to begin a heating process. In various embodiments, the switch is provided with a visual indicator of progress of a heating process. For example, the switch may be provided at the center of a light "bulb," where the light bulb includes one or more colored lights (e.g., LED lights). The light "bulb" may change colors during the heating process, acting like a timer. For example, at the beginning of a heating process, the bulb is entirely be red. As the heating process progresses, the light gradually turns green (e.g., segment by segment) until the light is entirely green, indicating completion of a heating stage or heating process. The light may gradually turn green segment by segment as if with the sweeping of a second hand of a clock, where a section to the left of the hour and minutes hands is red and a section to the right of the hour and minute hands is green until both hands are at 12:00 and the bulb is entirely green.

In various embodiments, the heating apparatus may include a user interface to display and/or receive user input. For example, a current power/energy level of a heating phase may be displayed on the user interface. In some embodiments, the energy levels are categorized Level 1 to Level 6 and a current power level of a heating phase is displayed on the user interface. The categorization may facilitate user comprehension of the energy level. Power/energy levels may be represented in an analog or continuous manner in some embodiments.

The heating apparatus 200 may be a variety of shapes as further described herein with respect to FIGS. 9 and 10. For example, heating apparatus 200 may be around 9 inches in diameter and around 2 inches in height. In some embodiments, the shape of the apparatus is compatible with an apparatus such as chamber 100 of FIG. 1. For example, the apparatus may be of a suitable surface area and shape to heat the contents of chamber 100.

Figure 3:
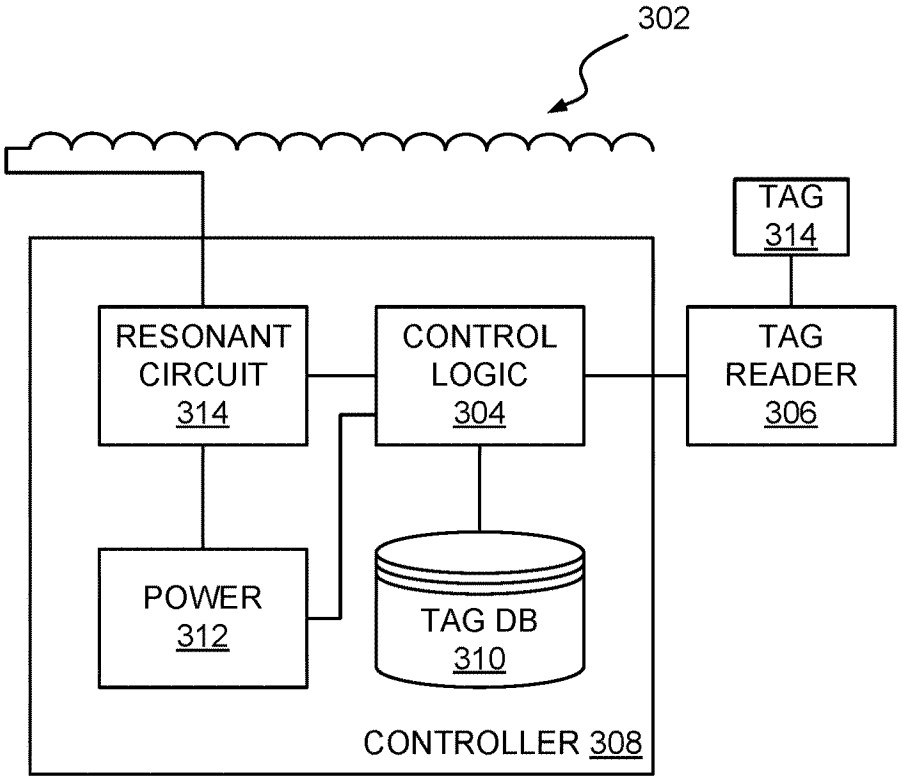
FIG. 3 is a block diagram of an embodiment of a controller for a heating apparatus.

FIG. 3 is a block diagram of an embodiment of a controller 308 for a heating apparatus. For example, the controller may be provided in heating apparatus 200 of FIG. 2. The controller 308 includes control logic 304, a tag database 310, resonant circuit 314, and power 312. In this example, the controller 308 is communicatively coupled to EM source 302 and tag reader 306.

The tag reader 306 reads a tag 314. The tag 314 may encode information about contents of a chamber. An example of tag reader 306 is electronic tag reader 206 of FIG. 2.

The control logic 304 is configured to receive tag information from the tag reader 306 and determine one or more heating cycles based on the tag information. In some embodiments, the control logic determines heating cycle(s) by looking up an association between the tag information and stored heating cycles. For example, the control logic may determine heating cycle(s) adapted to properties of a chamber in which the heatable load is provided and/or characteristics of the heatable load. In various embodiments, the control logic executes one or more processes described herein including process 400 of FIG. 4.

In some embodiments, the control logic is implemented by one or more processors (also referred to as a microprocessor subsystem or a central processing unit (CPU)). For example, the control logic 304 can be implemented by a single-chip processor or by multiple processors. In some embodiments, a processor is a general purpose digital processor that controls the operation of the heating apparatus 200. Using instructions retrieved from memory, the processor controls the reception and manipulation of input data, and the output and display of data on output devices (not shown).

The tag database 310 stores associations between heatable loads and heating cycles. For example, energy level, duration, and other properties of heating cycles may be stored in association with a load or characteristic(s) the load. In various embodiments, the associations are pre-defined and loaded into the database. In various embodiments, the associations are refined based on machine learning, user feedback, and/or sensor readings of heatable load properties before, during, or after a heating cycle. Although shown as part of the controller 308, the tag database may instead be external to the controller.

Figure 5:
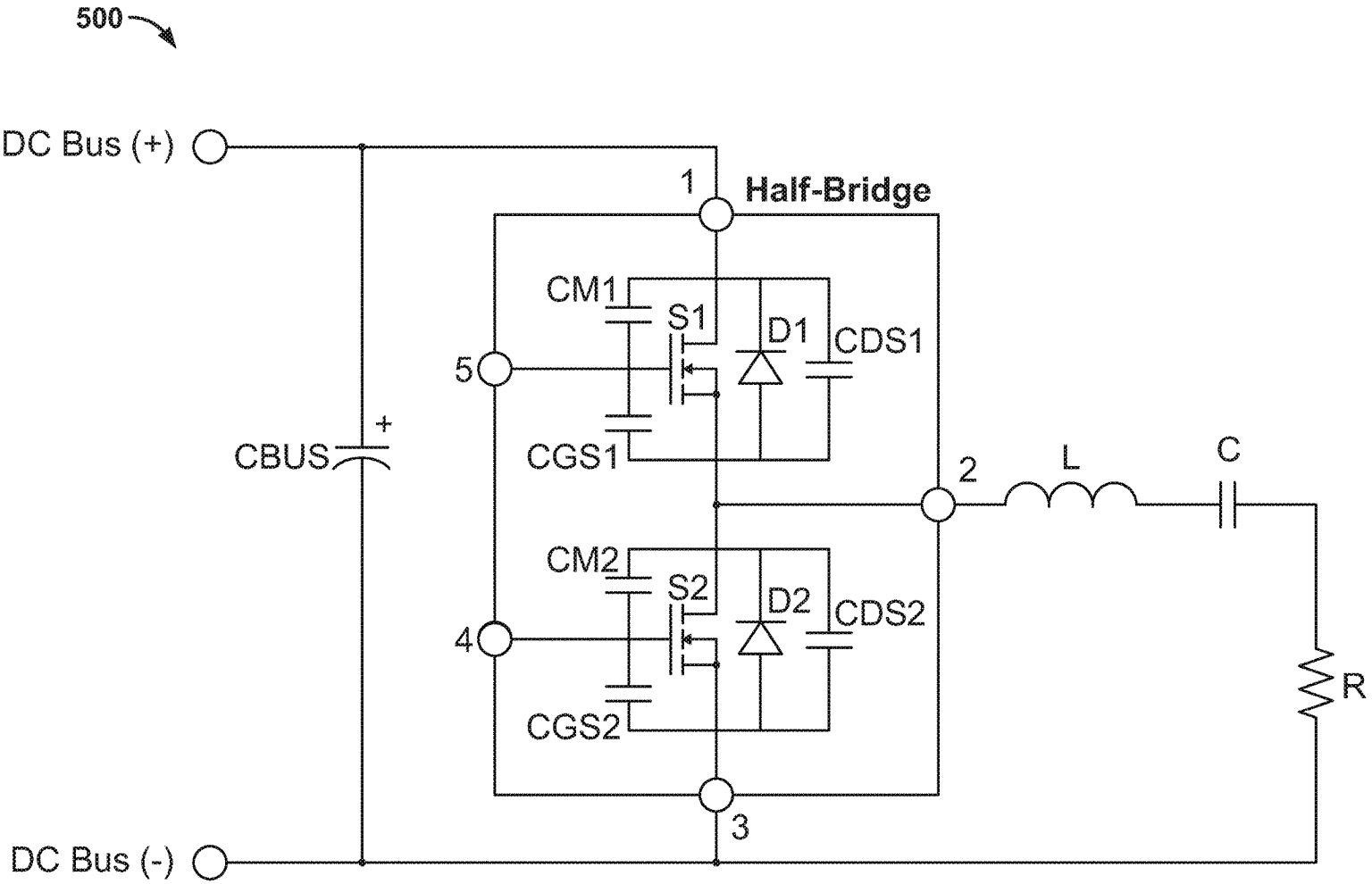
FIG. 5 is a schematic diagram illustrating an embodiment of a resonant converter circuit.

The resonant circuit 314 controls the EM source 302. An example of a resonant circuit is shown in FIG. 5. In some embodiments, the resonant circuit 314 has an integrated EM source 302, e.g., an inductor coil (not shown). In some embodiments, the EM source is a separate element from the resonant circuit 314.

The power 312 is input to the resonant circuit 314. In various embodiments, power 312 is a DC source. The DC source may be an internal or external DC source or may be adapted from an external AC source. Although shown as an internal source, the power may instead be external to the controller 308.

In operation, tag reader 306 read tag information from tag 314, and sends the information to the control logic 304. The control logic 304 maps the received tag information to one or more heating cycles using associations stored in tag database 310. The control logic 304 then instructs the resonant circuit 314 to execute the heating cycles. For example, the control logic 304 may also control when power 312 is provided to the resonant circuit 314. Resonant circuit 314 then activates the EM source 302.

Figure 4:
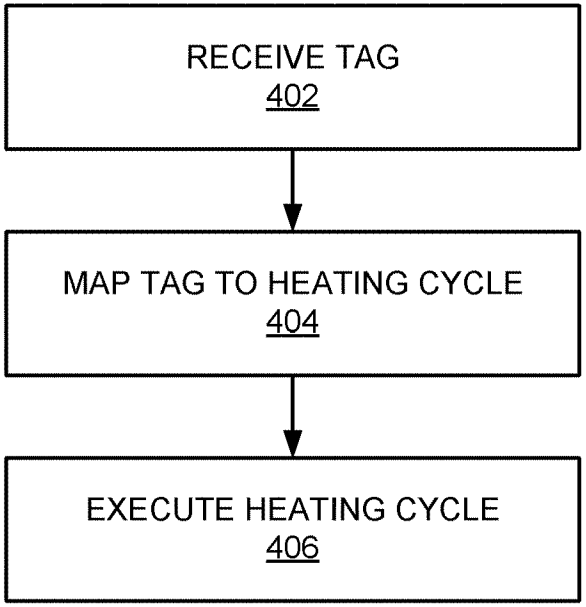
FIG. 4 is a flowchart illustrating an embodiment of a process to operate an automatic heating system.

FIG. 4 is a flowchart illustrating an embodiment of a process 400 to operate an automatic heating system. In various embodiments, the process 400 may be implemented by a processor such as control logic 304 of FIG. 3.

A tag is received (402). In various embodiments, the tag is an electronic tag associated with a heatable load. Tag 124 of FIG. 1 is an example of a tag encoding information about matter 130. Returning to FIG. 4, the tag is mapped to a heating cycle (404). In various embodiments, the tag is mapped by looking up an association between the tag and heating cycles. The heating cycles may be adapted for characteristics of a heatable load. The heating cycle may be defined by a duration and an energy level as further described herein. Upon determination of one or more heating cycles, the heating cycle(s) is executed (406). For example, in various embodiments control logic instructs a resonant circuit, e.g., 314 of FIG. 3, to drive an EM source, e.g., 302 of FIG. 3.

FIG. 5 is a schematic diagram illustrating an embodiment of a resonant converter circuit 500. In this example, the circuit 500 is a resonant half-bridge converter suitable for use in a controller of an EM source system such as the controller 208 of FIG. 2 or the controller 308 of FIG. 3. The components may be selected such that the resonance frequency is 25 kHz to 400 kHz. In this example, inductor L represents inductance resulting from interaction between a metal layer of an apparatus such as 114 and an EM source of a heating apparatus such as 202. R is an equivalent resistance resulting from interaction between a metal layer of an apparatus such as 114 and an EM source of a heating apparatus such as 202.

Figure 6A:
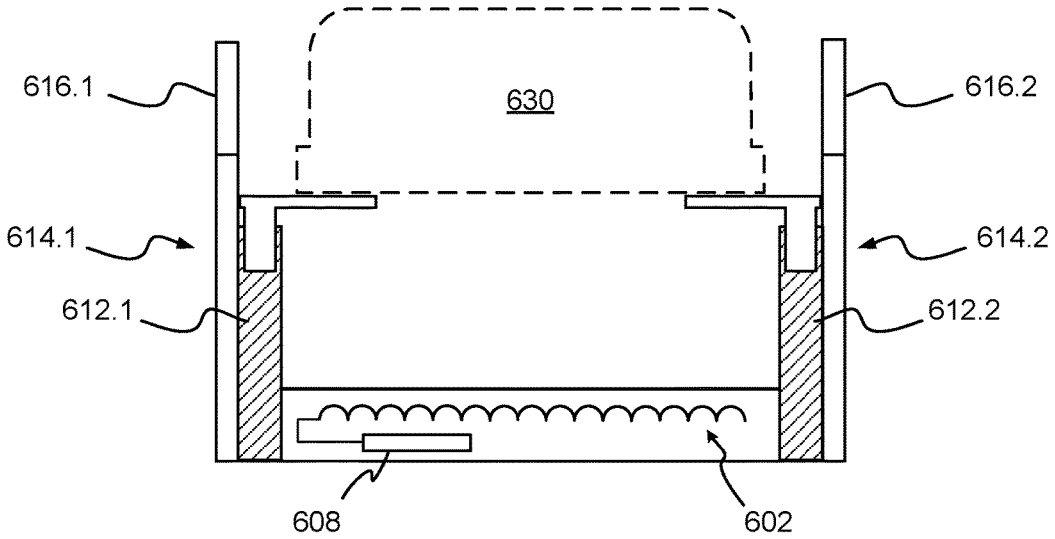
FIG. 6A is a block diagram illustrating an embodiment of a heating apparatus in a first state.

FIG. 6A is a block diagram illustrating an embodiment of a heating apparatus in a first state 600. The apparatus includes a moving mechanism comprising a first arm 612.1 and a second arm 612.2, a clamp comprising a first arm 614.1 and second arm 614.2, a controller 608, and an EM source 602. For simplicity, the heating apparatus is shown only with controller 608 and EM source 602. In various embodiments, the heating apparatus includes other components such as sensors, a tag reader, etc. heating apparatus 200 of FIG. 2 is an example of the heating apparatus.

The moving mechanism (612.1, 612.2) is adapted to support and move the chamber 630. In this example, the pair of arms 612.1, 612.2 are configured to raise and lower the chamber 630. Here, the apparatus is in a loading/unloading state 600 in which the pair of arms 612.1, 612.2 are raised, e.g., portion 616.1, 616.2 of the clamps are positioned such that it does not interfere with movement of the chamber 630. The moving mechanism may operate mechanically and/or electronically, e.g., by hydraulics, springs, etc. In various embodiments, apparatus 630 may be held in places by one or more latches. For example, a user may push an apparatus onto a heating apparatus, where the apparatus rests on one or more springs (e.g., recoil springs) and latch in place during a heating process. At the conclusion of the heating process, a magnetic field may be passed through solenoids in the heating apparatus causing the latches to release and the apparatus to lift up (in reaction to a nature position of the spring(s)). In various embodiments, latching and unlatching of the apparatus may be assisted by a motor.

The clamp 614.1, 614.2 is adapted to secure the chamber 630. In various embodiments, the clamp 614.1, 614.2 secures a top portion to a bottom portion of the chamber (e.g., top portion 110 to bottom portion 112 of FIG. 1) as further described with respect to FIG. 6B. In various embodiments, the clamp includes a joint by which two portions of the clamp are movably connected. In state 600, the clamp is shown in a disengaged state, enabling the chamber to be removed from the heating apparatus/base. In this example, in the disengaged state, arms 612.1 and 612.2 are positioned in substantially a same plane as a remainder of the clamp allowing the chamber to be removed from the heating apparatus.

An example of the EM source 602 is EM source 202 of FIG. 2. An example of the controller 608 is controller 208 of FIG. 2 and controller 308 of FIG. 3.

Figure 6B:
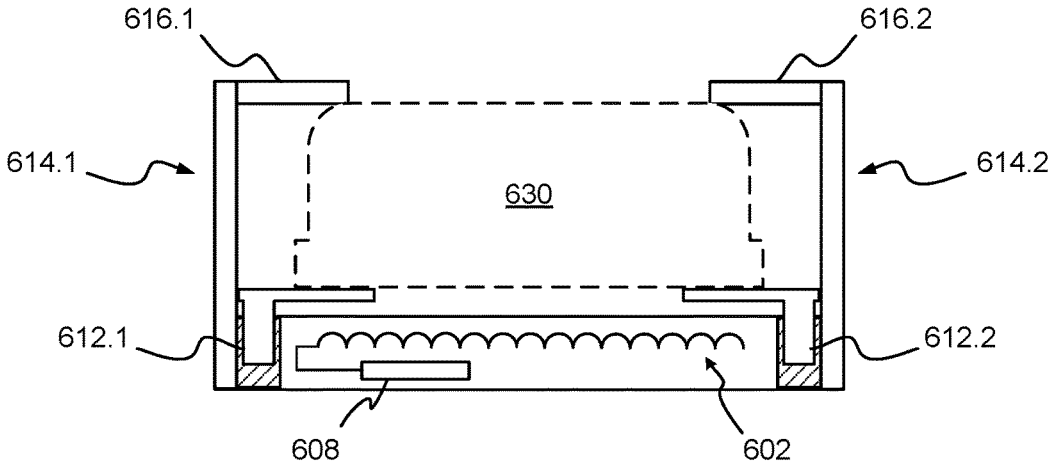
FIG. 6B is a block diagram illustrating an embodiment of a heating apparatus in a second state.

FIG. 6B is a block diagram illustrating an embodiment of a heating apparatus in a second state 650. The apparatus includes a moving mechanism comprising a first arm 612.1 and a second arm 612.2, clamps 614.1 and 614.2, an EM source 602, and controller 608. Each of the components function in the same manner as the corresponding component in FIG. 6A unless otherwise described herein.

In this example, the apparatus is in a secured state 650 in which a top portion of chamber 630 is secured to a bottom portion.

In various embodiments, cooking is performed in the secured state 650. For example, the chamber 630 is brought into proximity with the EM source 602, sensors 604, and electronic tag reader 606. The pair of arms 616.1 and 616.2 are engaged with a top portion of chamber 630, bent at the joint. In various embodiments, a pair of clamps 614.1, 614.2 secures the chamber 630. As shown, portion 616.1 of clamp 614.1 and portion 616.2 of clamp 614.2 are rotated to secure a top portion to a bottom portion of the chamber (e.g., top portion 110 to bottom portion 112 of FIG. 1). In various embodiments, portion 616.1, 616.2 is manually or automatically locked into place in state 650. In the secured state, the top portion may be prevented from becoming separated from the bottom portion, even at relatively high pressures. In another aspect, in the secured state, the chamber may be engaged with a heating apparatus, e.g., aligned.

In operation, during a heating process, the chamber 630 is placed on the moving mechanism (612.1, 612.2). The moving mechanism then lowers chamber 630 to reach state 650. In some embodiments, clamps 614.1, 614.2 are activated to secure the chamber. The heating may automatically begin. Upon completion of heating, the moving mechanism raises the chamber 630, returning to state 600. The raising and lowering of the chamber may indicate when food is being prepared (e.g., lowered) and when food is ready for consumption (e.g., raised). As further described herein with respect to FIGS. 12A and 12B, a plurality of heating apparatus may be coordinated to simultaneously lower and raise respective chambers.

Figure 11B:
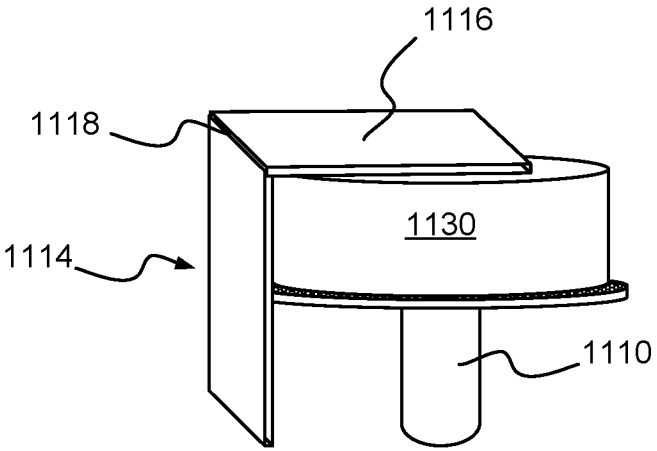
FIG. 11B is a block diagram illustrating an embodiment of a heating system in a second state.
Figure 11A:
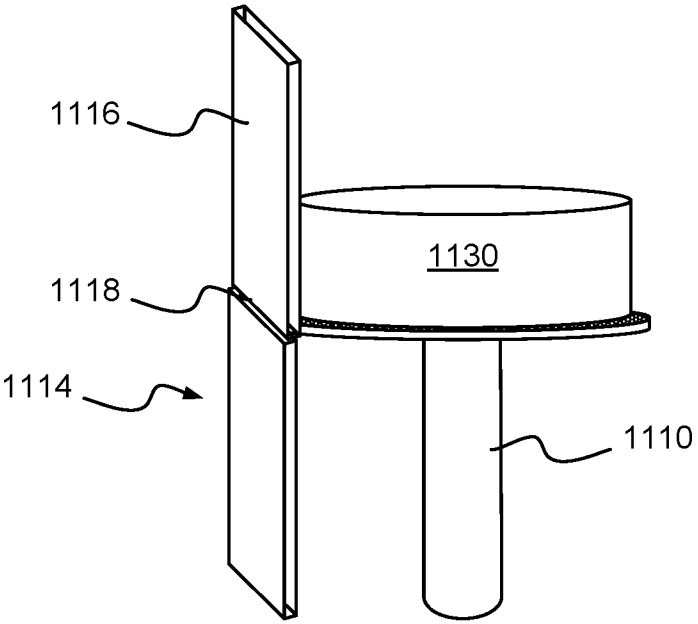
FIG. 11A is a block diagram illustrating an embodiment of a heating system in a first state.

Other moving mechanisms are possible as further described herein with respect to FIGS. 11A and 11B. For example, a moving mechanism may be implemented by a single arm or more than two arms. Other clamps are possible. For example, a clamp may be implemented by a single arm or more than two arms. In some embodiments, the moving mechanism accommodates top-loading engagement of the chamber with a heating apparatus. In some embodiments, the moving mechanism accommodates side-loading engagement of the chamber with a heating apparatus.

Figure 7:
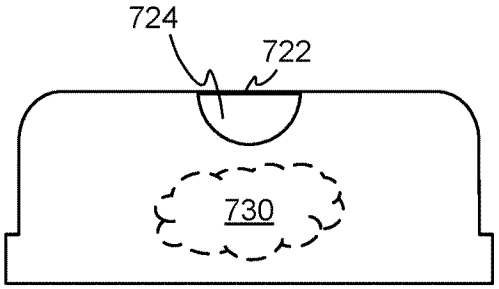
FIG. 7 is a block diagram illustrating an embodiment of an apparatus to store and transport matter.

FIG. 7 is a block diagram illustrating an embodiment of an apparatus 700 to store and transport matter 730. In some embodiments, the apparatus has the same components and characteristics as apparatus 100 of FIG. 1 unless otherwise described here. For simplicity, various components that may be provided with the apparatus are not shown. For example, the apparatus may include a metal layer, membrane region, electronic tag, seal, etc. The apparatus 700 includes a handle 722. In the example shown, the handle is substantially flush with a top surface of the apparatus 700. The apparatus has a hollowed out section 724 allowing the handle 722 to be grasped. This example configuration allows the apparatus to be stacked one on top of another.

Figure 8:
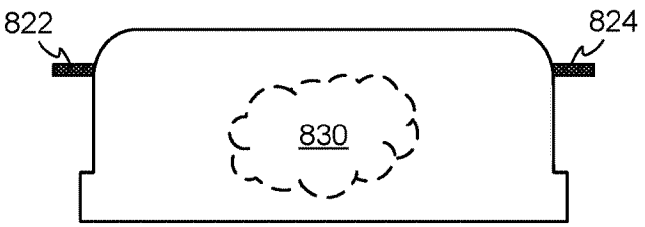
FIG. 8 is a block diagram illustrating an embodiment of an apparatus to store and transport matter.

FIG. 8 is a block diagram illustrating an embodiment of an apparatus 800 to store and transport matter 830. In some embodiments, the apparatus has the same components and characteristics as apparatus 100 of FIG. 1 unless otherwise described here. For simplicity, various components that may be provided with the apparatus are not shown. For example, the apparatus may include a metal layer, membrane region, electronic tag, seal, etc. The apparatus 800 includes a first handle 822 and a second handle 824. In the example shown, the first handle 822 is provided on a first side wall and the second handle 824 is provided on a second side wall opposite the first side wall. This example configuration allows the apparatus to be stacked one on top of another.

FIG. 9 is a block diagram illustrating an embodiment of a system 900 for heating in a perspective view. The system includes apparatus 900 and heating apparatus 950. The apparatus (also referred to as a chamber) includes top portion 910 and bottom portion 912. The chamber is configured to hold and transport matter 930 (e.g., food). An example of the chamber is apparatus 100 of FIG. 1. In the example shown in FIG. 9, the chamber is cylindrical. The heating apparatus 950 is compatible with the chamber 900, e.g., matching a bottom portion 912 of the chamber. In various embodiments, the heating apparatus has a slightly smaller or slightly larger surface area compared with the bottom portion 912 of the chamber. An example of the heating apparatus is apparatus 200 of FIG. 2.

FIG. 10 is a block diagram illustrating an embodiment of a system 1000 for heating in a perspective view. The system includes chamber 1000 and heating apparatus 1050. The chamber includes top portion 1010 and bottom portion 1012. The chamber is configured to hold and transport matter 1030 (e.g., food). An example of the chamber is apparatus 100 of FIG. 1. In the example shown in FIG. 10, the chamber is a rectangular prism. The heating apparatus 1050 is compatible with the chamber 1000, e.g., matching a bottom portion 1012 of the chamber. In various embodiments, the heating apparatus has a slightly smaller or slightly larger surface area compared with the bottom portion 1012 of the chamber. An example of the heating apparatus is apparatus 200 of FIG. 2.

FIG. 11A is a block diagram illustrating an embodiment of a heating system in a first state 1100. FIG. 11B is a block diagram illustrating an embodiment of a heating system in a second state 1150. The apparatus includes a moving mechanism 1110, a clamp 1114, and a chamber 1130. In the first state 1100, the apparatus is raised. In this example, the clamp 1114 is configured to bend at hinge 1118. In state 1100, portion 1116 of clamp 1114 is substantially in the same plane with the remainder of the clamp 1114, allowing chamber 1130 to be positioned on moving mechanism 1110. In a second state 1150, the chamber 1130 is lowered via moving mechanism 1110. In this example, portion 1116 is bent at hinge 1118 and substantially perpendicular to the remainder of the clamp 1114. This may ensure that a top portion of chamber 1130 remains in place (e.g., engaged with a bottom portion) even if there is a pressure buildup in the chamber 1130.

Figure 12A:
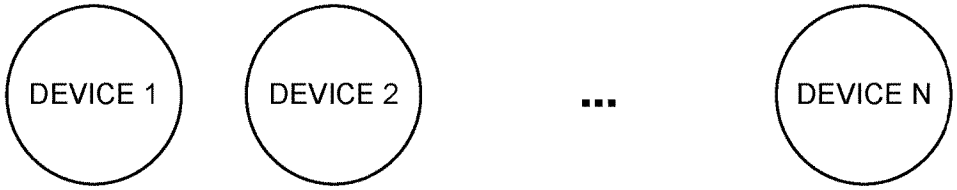
FIG. 12A is a block diagram illustrating an embodiment of a modular heating system.

FIG. 12A is a block diagram illustrating an embodiment of a modular heating system 1200. The system 1200 includes a plurality of sub-units (labelled as "devices"). In this example, the sub-units of the system are heating apparatus, e.g., N heating apparatus. An example of a heating apparatus is heating apparatus 200 of FIG. 2. In various embodiments, the sub-units are communicatively coupled to at least their adjacent sub-units. For example, the sub-units may communicate by wired or wireless means such as Bluetooth®, WiFi®, and/or other local area network protocols. For example, in various embodiments, the sub-units each have a network interface such as the network interface described with respect to FIG. 2.

The sub-units may be configured to coordinate operation such that the system operates as a single unit. For example, one of the sub-units may be appointed as a master and communicate with the other slave sub-units of the system. If the master is removed from the system, another sub-unit may be appointed as the master. As another example, each of the sub-units may be instructed to operate (e.g., delay beginning of a heating cycle) by a central server.

The system 1200 is expandable and accommodates sub-units that may be added or removed after an initial set-up. For example, the heating apparatus need not be acquired at the same time. When a heating apparatus is added to the system, the heating apparatus is automatically configured to communicate and coordinate with the other heating apparatus as further described herein. When a heating apparatus is removed from the system, the system is automatically updated.

In various embodiments, one or more sub-units of system 1200 is configured to coordinate meal preparation. For example, the heating apparatus may be configured to finish heating at the same time. Those heating apparatus with contents having shorter heating times may delay the start time such that more than one of the heating apparatus finish at the same time.

Suppose Device 1 is instructed to cook steak, which takes 3 minutes, Device 2 is instructed to cook spinach, which takes 1 minute, and Device N is instructed to cook mashed potatoes, which takes 1.5 minutes. Device 1 begins first, 1.5 minutes later, Device N begins, and 30 seconds after Device N begins, Device 2 begins. Thus, Devices 1, 2, and N will finish heating at the same time.

As another example, the devices may be configured to finish heating at staggered times. Using the same example in which Device 1 is instructed to cook steak, which takes 3 minutes, Device 2 is instructed to cook spinach, which takes 1 minute, and Device N is instructed to cook mashed potatoes, which takes 1.5 minutes, suppose mashed potatoes need more time to cool down. Devices 1 and 2 may be configured to finish at the same time, and Device N may be configured to finish 1 minute before Devices 1 and 2 finish. Device 1 begins first, 0.5 minutes later, Device N begins, and 1.5 minutes after Device N begins, Device 2 begins. Thus, Devices 1 and 2 will finish heating at the same time (3 minutes after Device 1 began) and Device N will finish heating 1 minute before Devices 1 and 2 are finished.

Figure 12B:
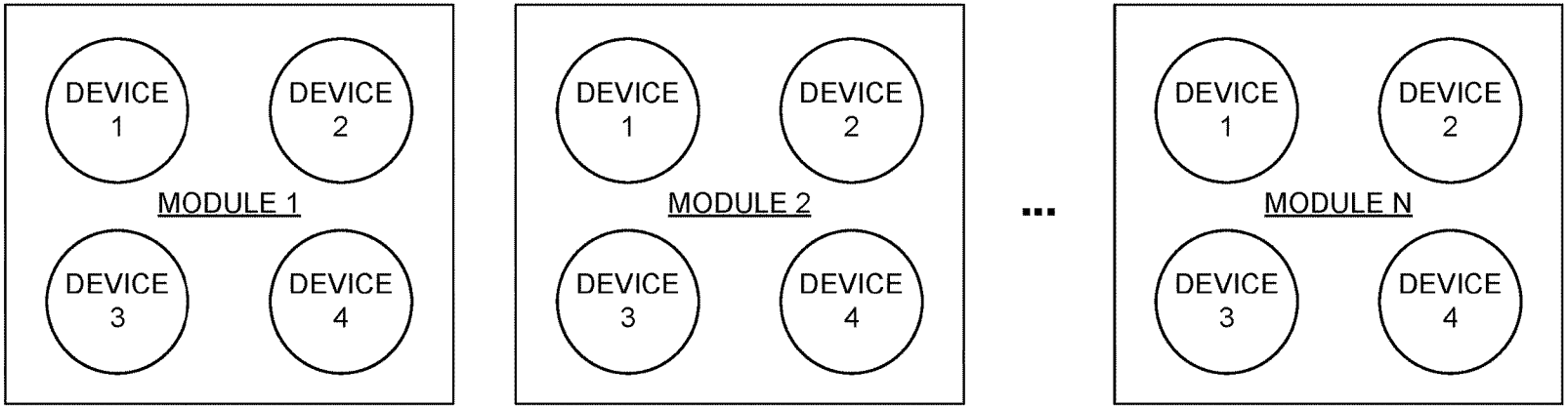
FIG. 12B is a block diagram illustrating an embodiment of a modular heating system.

FIG. 12B is a block diagram illustrating an embodiment of a modular heating system 1250. The system 1250 includes a plurality of sub-units (labelled as "devices"). In this example, the sub-units of the system are modules, e.g., N modules. Each of the modules includes four heating apparatus, Device 1 to Device 4. An example of a heating apparatus is heating apparatus 200 of FIG. 2. In various embodiments, the sub-units are communicatively coupled to at least their adjacent sub-units. For example, the sub-units may communicate by wired or wireless means such as Bluetooth®, WiFi®, and/or other local area network protocols. For example, in various embodiments, the sub-units each have a network interface such as the network interface described with respect to FIG. 2.

In various embodiments, the modules may be configured to coordinate operation of constituent heating apparatus. For examples, Device 1 to Device 4 are configured to finish heating at the same time or pre-defined staggered finish times. In various embodiments, the modules may be configured to coordinate operation with each other. For example, Modules 1 to N are coordinated to finish heating at the same time or pre-defined staggered finish times.

Suppose system 1250 is preparing a meal for two people, where each meal includes four courses. Each of the courses may be packaged in a chamber such as apparatus 100 of FIG. 1. In some embodiments, the chambers may be loaded into the devices at the same time and configured to be finished heating at pre-defined times (e.g., at the same time or pre-selected staggered times).

There are a variety of ways to load the chambers into the devices/modules. In a first example, each of the courses for the first person is inserted into a respective device in Module 1. Each of the courses for the second person is inserted into a respective device in Module 2. For example, Device 1 in each module receives a package for a starter, Device 2 in each module receives a package for an intermediate course, Device 3 in each module receives a package for a main course, and Device 4 in each module receives a package for a dessert. The packages may all be inserted into the cookers at the same time.

In a second example, courses of the same type are inserted into the same module. For example, a starter package is inserted into Device 1 and Device 2 of Module 1, an intermediate course package is inserted into Device 3 and Device 4 of Module 1, a main course package is inserted into Device 1 and Device 2 of Module 2, and a dessert package is inserted into Device 3 and Device 4 of Module 2.

In operation, the modules may coordinate to finish cooking the starter first, finish cooking the intermediate course 10 minutes after cooking of the starter is completed, finish cooking the main course 15 minutes after cooking of the intermediate course is completed, and finish cooking the dessert 20 minutes after cooking of the main course is completed. The modules may factor in the time is takes to prepare each of the courses in determining when to begin cooking each of the courses to meet the defined finish time. The end times may be adapted to a user, e.g., based on usage habits and/or preferences provided by a user or associated with a user profile. In various embodiments, the heating apparatus is configured for use in a top-loading manner (e.g., like loading matter into a pot or pan on a cooktop). In various embodiments, the heating apparatus is configured for use in a side-loading manner (e.g., like loading matter into a conventional oven).

Although the foregoing embodiments have been described in some detail for purposes of clarity of understanding, the invention is not limited to the details provided. There are many alternative ways of implementing the invention. The disclosed embodiments are illustrative and not restrictive.

What is claimed is:

1. An apparatus comprising:

a top portion; and a bottom portion adapted to receive the top portion to define a space enclosed within the top portion and the bottom portion, wherein the bottom portion comprises:

a conductive structure configured to receive electromagnetic energy from an EM source;

a membrane below the conductive structure, the membrane adapted to provide controlled flow of moisture through the membrane and release of liquid into the enclosed space; and an electronic tag configured to encode information about contents of the space, wherein the electronic tag is readable by a remote heating apparatus to heat the contents of the enclosed space.

2. The apparatus of claim 1, wherein the conductive structure is inside the space enclosed within the top portion and the bottom portion.

3. The apparatus of claim 1, wherein the apparatus is portable.

4. The apparatus of claim 1, wherein the space is adapted to store a heatable load.

5. The apparatus of claim 1, wherein the apparatus is adapted to be directly provided to a heating apparatus to heat contents inside the space enclosed within the top portion and the bottom portion.

6. The apparatus of claim 1, wherein the membrane provides controlled flow of moisture through the membrane during heating.

7. The apparatus of claim 1, wherein the released liquid is water.

8. The apparatus of claim 1, further comprising a pressure relief valve adapted to control pressure inside the space.

9. The apparatus of claim 1, further comprising a pressure relief valve adapted to control pressure inside the space, wherein the pressure relief valve is automatically deployed during a heating process when a threshold pressure is met.

10. The apparatus of claim 1, further comprising a pressure relief valve adapted to control pressure inside the space, wherein the pressure relief valve is deployed by a heating apparatus.

11. The apparatus of claim 1, further comprising a handle.

12. The apparatus of claim 1, wherein the electronic tag encodes instructions to process contents of the apparatus.

13. The apparatus of claim 1, wherein the electronic tag is an RFID.

14. The apparatus of claim 1, wherein the membrane is provided between the conductive structure and the electronic tag.

* * * * *